United States Patent [19]

Reynolds et al.

[11] 4,192,676

[45] Mar. 11, 1980

[54] HIGH TEMPERATURE REDUCTION OF COPPER SALTS

[75] Inventors: James E. Reynolds, Golden; Wayne C. Hazen, Denver; Duane N. Goens, Golden, all of Colo.

[73] Assignee: Cyprus Metallurgical Processes Corporation, Los Angeles, Calif.

[21] Appl. No.: 905,091

[22] Filed: May 11, 1978

[51] Int. Cl.[2] ..... C22B 15/00

[52] U.S. Cl. ..... 75/72; 75/91

[58] Field of Search ..... 75/72, 91, 26, 0.5 B, 75/40; 266/204

[56] References Cited

U.S. PATENT DOCUMENTS

| | | | |
|---|---|---|---|
| 1,671,003 | 5/1928 | Bagsar | 75/91 |
| 4,017,307 | 4/1977 | Winterhager et al. | 75/72 |
| 4,039,324 | 8/1977 | Stephens, Jr. et al. | 75/72 |

*Primary Examiner*—L. Dewayne Rutledge
*Assistant Examiner*—Peter K. Skiff
*Attorney, Agent, or Firm*—Sheridan, Ross, Fields & McIntosh

[57] ABSTRACT

Copper is recovered from copper salts selected from the group consisting of copper chlorides, copper oxides and copper oxychlorides by reducing the finely divided solid copper salts with hydrogen under turbulent conditions at a temperature greater than the melting point of elemental copper.

30 Claims, No Drawings

HIGH TEMPERATURE REDUCTION OF COPPER SALTS

BACKGROUND OF THE INVENTION

1. Field of the Invention

This invention is concerned with a process of recovering copper from various copper salts by means of hydrogen reduction at temperatures exceeding the melting point of copper.

2. The Prior Art

Many processes have been taught for the hydrogen reduction of metallic salts to recover the elemental metal. For example, U.S. Pat. No. 2,111,661 to Ebner discloses the passing of finely divided molten magnesium chloride through a reaction chamber of hydrogen gas at a temperature of 1200° C. to 1500° C. in order to reduce the magnesium chloride to magnesium. Thereafter, the magnesium is recovered by condensation.

Several techniques deal specifically with copper salts. Baghdasarian in U.S. Pat. No. 1,671,003 discloses chlorinating metallic sulfides at temperatures in the range of 900° to 1200° C. to their corresponding metallic chlorides, and then reducing the metallic chlorides with hydrogen to produce the elemental metal and hydrogen chloride. The preferred temperature disclosed for reducing lead chloride with hydrogen is in excess of 800° C.; whereas, a lower temperature is taught to be preferable for the reduction of copper chlorides.

Additionally, a cyclone reaction chamber has been used in a smelting process for impure copper concentrates. "The KIVCET Cyclone Smelting Process for Impure Copper Concentrates" *Journal of Metals,* July, 1976, page 4, teaches the oxidation and slagging of the copper in a cyclone with the reduction of copper occurring in the settling hearth at temperatures of about 1350° to 1400° C.

Many of these processes have problems with the reduced copper agglomerating and sintering. U.S. Pat. No. 4,039,324 to Stephens, Jr. et al circumvents this problem by reducing the copper salts with hydrogen at a temperature of from about 200° to about 1000° C. in a fluidized bed in the presence of chemically inert, generally spherical, relatively smooth, non-porous particles.

However, none of the prior art teaches the hydrogen reduction of solid copper bearing material at a temperature greater than the melting point of copper under conditions which result in substantially instantaneous copper reduction coupled with efficient fume collection.

SUMMARY OF THE INVENTION

Copper salts selected from the group consisting of copper chlorides, copper oxides and copper oxychlorides are reduced to elemental copper by injecting the copper salts into a reactor in solid particulate form and reducing these salts with hydrogen under turbulent conditions at a temperature greater than the melting point of copper. The reaction conditions must be such as to allow the copper bearing material to be intimately contacted with the hydrogen gas essentially at the moment it is fed into the reactor so as to cause an essentially instantaneous reaction with the hydrogen gas.

At the temperature of this process, copper oxides are reduced as solids essentially instantaneously upon their injection into the reactor. The resulting elemental copper collects as a liquid and is recovered. Copper chlorides are injected into the reactor in solid form, and the reactor temperature is such that these chlorides flash vaporize immediately. It is necessary to contact this vapor immediately with hydrogen, resulting in an instantaneous reaction, followed by processing to collect the reduced fumes. This is preferably accomplished by creating a cyclonic effect in the reactor, thereby coalescing the fumes as liquid elemental copper. Other fume collection techniques may be employed in lieu of or in combination with this cyclone technique.

DESCRIPTION OF THE PREFERRED EMBODIMENTS

The process of the present invention is useful in the recovery of elemental copper from various copper salts, including copper oxides, copper chlorides and copper oxychlorides. It is particularly useful for the reduction of copper values which tend to agglomerate or sinter upon reduction conditions taught in the prior art. These copper values include to some degree copper oxides, and particularly include cupric chloride and cuprous chloride.

The copper bearing material must be introduced into the reaction chamber as a finely divided solid. The melting point of copper oxide is above 2000° C., and therefore when processing this compound and when the reaction temperature is less than its melting point, copper oxide is easily introduced in solid form. Cupric chloride at the required reaction temperature reduces to cuprous chloride. Cuprous chloride has a melting point of about 430° C., and has a relatively high vapor pressure at the reaction temperature. This compound therefore immediately flash vaporizes when injected into a reaction vessel having a temperature in excess of 1083° C. The copper oxychloride mechanism is somewhat more complex and most probably will behave either as copper oxide as a result of its decomposition to this compound, or as a copper chloride as a result of immediate vaporization.

When dealing with feed components having a melting point less than the reaction temperature, it is necessary to maintain the feed in solid form until it is injected into the reaction vessel. This may be accomplished, for example, by injecting the feed through a water-cooled or insulated injector nozzle. If necessary the injector nozzle may extend into the reaction vessel. Other techniques which would maintain the feed in solid form until it is in the reaction vessel may also be employed.

A necessary element of the invention, in order to insure a substantially instantaneous reduction reaction as hereinafter discussed, is the introduction into the reactor of the feed in relatively small particle size. The maximum size limitation is dependent upon reactor design, feed composition, reaction temperature and other variables. Preferably the feed is sized at less than about 500 microns, and more preferably less than about 100 microns.

The amount of hydrogen gas employed is in accordance with stoichiometric requirements. An excess amount of hydrogen is usually employed, although under the preferred reaction conditions the reaction is quite efficient and hence the excess generally need not be too great.

The actual reduction of the copper bearing materials can occur at a temperature as low as 200° C. However, in the present process, the reduction reaction must be carried out at a temperature of at least about 1083° C, and preferably not in excess of about 1400° C. More preferably the reaction temperature is maintained from about 1100° C. to about 1300° C., and most preferably from about 1100° C. to about 1200° C.

The essence of the invention is to effect a high degree of copper reduction substantially instantaneously upon introduction of the copper feed into the reactor. The preferred residence time in the reactor of the copper feed and resulting reduced copper is less than about 10 seconds, more preferably less than about 3 seconds, and most preferably less than about 1 second.

The reactor capacity is limited by the ability to maintain the necessary reaction temperature. Since the reaction is endothermic, much of the heat required must be supplied through the reactor walls, by means of convection and radiation at the surface of the interior wall. Hence, the capacity is controlled by the reactor design, and the preferred designs maximize wall surface area per volume of the reactor.

In order to accomplish such an instantaneous reaction, the copper feed materials must immediately be subjected to the hydrogen. Hence the respective inlets for the copper feed and the hydrogen should be such as to bring the two reactants into contact as soon as the copper salts enter the reactor. Under properly controlled injection techniques the hydrogen may serve as the carrier gas for the solid copper feed, but care must be taken to avoid excessive reduction of copper prior to entering the reactor in order to prevent fouling of the injection lines. When hydrogen is injected separately from the copper feed, it is preferred to inject the copper feed by means of an inert gas carrier. Examples of such gases include neutral combustion gases, nitrogen, argon and helium.

Due to the instantaneous aspect of the invention, the flow conditions in the reactor must be quite turbulent in order to allow for the rapid and intimate contact between the copper bearing material, whether it be in solid or vapor form, and the hydrogen. Such turbulent conditions also aid in the necessary heat transfer in order to maintain the required reaction temperature.

The reduced copper particles immediately resulting from the reaction are generally of the near sub-micron size, and in accordance with the reaction temperature the particles are in liquid form. The collection of such particles is preferably accomplished as much as possible within the reactor. A preferred technique is the utilization of a cyclone flow pattern within the reactor. Such a pattern permits the small particles to collect and coalesce into sufficiently large liquid particles in order to facilitate the copper recovery.

Such a cyclone is preferably created by injecting a gas tangentially into a cylindrically shaped reactor. The inlet gas velocity is dependent upon reactor design, and is generally from about 9 to about 27 meters per second, and preferably from about 17 to about 22 meters per second. The gas may be hydrogen or a gas inert to the system. When this cyclone technique is employed, the copper feed is preferably injected into the vortex of the cyclone or parallel thereto.

Other collection techniques may be employed in lieu of or in combination with this cyclone technique. Such techniques include gravity settling in large chambers, wet scrubbing, with collection of the copper as a powder cake, dry fabric filtering, and other known fine particle collection techniques.

EXAMPLES

All examples were carred out in a cylindrically shaped graphite reactor having a diameter of two and one-half inches.

EXAMPLE I

Nitrogen gas was used at a rate of 20 standard cubic feet per hour (0.6 cubic meters per hour) to carry 454 grams of cuprous oxide and 265 grams of cupric oxide into the vortex of a cyclone reactor at a rate of 0.6 and 0.5 kilograms per hour, respectively. Hydrogen gas was fed tangentially into the cyclone reactor at a rate of 7 standard cubic feet per hour (0.2 cubic meters per hour). The reduction reaction, which was carried out at a temperature of about 1130° C. with the gases being retained in the reactor chamber for 0.9 seconds, resulted in 94.9% of the copper present in the feed being reduced.

EXAMPLE II

Two hundred and eighty five grams of cuprous chloride, sized to 100 microns carried by nitrogen gas at a rate of 21 standard cubic feet per hour (0.6 cubic meters per hour) and argon gas at a rate of 3 standard cubic feet (0.1 cubic meters per hour) per hour was fed through a water-cooled gun axially into a cyclone reactor. Hydrogen gas was fed tangentially into the cyclone reactor at a rate of 8 standard cubic feet per hour (0.2 cubic meters per hour). The reduction reaction occurred at a temperature of about 1100° C. and the gases had a residence time in the reaction chamber of 0.7 seconds. The copper chloride was fed into the reactor at a rate of 0.4 kilograms per hour with 92.8% of the copper in the feed material being reduced.

EXAMPLE III

Nitrogen gas and argon gas in amounts of 40 standard cubic feet per hour (1.1 cubic meters per hour) and 3 standard cubic feet per hour (0.1 cubic meters per hour), respectively, was used to carry 335 grams of cuprous chloride sized to 100 microns into a water-cooled gun which fed the cuprous chloride axially into a cyclone reactor at a rate of 0.2 kilograms per hour. Hydrogen gas was fed tangentially into the cyclone reactor at a rate of 8 standard cubic feet per hour (0.2 cubic meters per hour). The reduction reaction temperature was about 1093° C. and the residence time in the reactor was 0.5 seconds. This resulted in 98.6% of the copper in the feed material being reduced.

EXAMPLE IV

Recrystallized cuprous chloride was sized to 100 microns and 1.05 kilograms was fed through a water-cooled feed gun axially into a cyclone reactor at a rate of 0.7 kilograms per hour. The cuprous chloride was carried by an inert gas consisting of nitrogen and argon in amounts of 40 standard cubic feet per hour (1.1 cubic meters per hour) and 3 standard cubic feet per hour (0.1 cubic meters per hour), respectively. Hydrogen was fed tangentially into the cyclone reactor at a rate of 8 standard cubic feet per hour (0.2 cubic meters per hour). The reduction reaction was carried out at a temperature of 1085° C. and the gases were retained in the reactor chamber for 0.5 seconds. This resulted in 89.9% of the copper being reduced from the feed material.

What is claimed is:

1. A process for reducing copper bearing materials selected from the group consisting of copper chlorides and copper oxychlorides to elemental copper with hydrogen which comprises:

injecting the copper bearing materials into a reactor in finely divided solid form;

maintaining the reactor temperature in excess of 1083° C.;

contacting the copper bearing materials with hydrogen under conditions which require intimate contact and a substantially instantaneous reduction reaction in order to produce liquid elemental copper.

2. The process of claim 1 wherein the copper bearing material is a copper chloride.

3. The process of claim 2 wherein the copper chloride is selected from the group consisting of cuprous chloride and cupric chloride.

4. The process of claim 3 wherein the copper chloride is cuprous chloride.

5. The process of claim 3 or 4 wherein the copper chloride is immediately vaporized upon entering the reactor.

6. The process of claim 1 wherein the copper bearing materials are finely divided to a particle size of less than 500 microns prior to being injected into the reactor.

7. The process of claim 1 wherein the reduction reaction occurs within one second of the injection of the copper bearing material into the reactor.

8. The process of claim 1 wherein the reaction occurs in a cyclone.

9. A process for reducing copper chloride with hydrogen to elemental copper comprising:

injecting the copper chloride into a reactor in finely divided solid form;

maintaining the temperature of the reactor at greater than 1083° C. in order to cause the immediate flash vaporization of the copper chloride upon entering the reactor; and intimately contacting the copper chloride with hydrogen in order to substantially instantaneously reduce the copper chloride to liquid elemental copper.

10. The process of claim 9 wherein the reactor is maintained at a temperature of from about 1100° C. to about 1300° C.

11. The process of claim 9 wherein the substantially instantaneous reduction reaction occurs within one second of the injection of the copper bearing material into the reactor.

12. The process of claim 9 wherein the reaction occurs in a cyclone.

13. The process of claim 9 wherein the copper bearing material is cuprous chloride.

14. A process for recovering elemental copper from copper bearing materials selected from the group consisting of, copper chlorides and copper oxychlorides which comprises:

maintaining the temperature of the interior walls of a reactor at a temperature of from about 1083° C. to about 1400° C.;

introducing a gas into the reactor at a sufficient velocity and angle to create a cyclone within the reactor;

introducing the copper bearing material as a finely divided solid and hydrogen into the reactor under conditions which cause a substantially instantaneously reduction reaction to form elemental copper; and recovering the liquid elemental copper.

15. The process of claim 14 wherein the hydrogen is injected tangentially into the reactor at a velocity of from about 9 to about 27 meters per second.

16. The process of claim 14 wherein the copper bearing material reacts within one second with the hydrogen gas to form elemental copper.

17. The process of claim 14 wherein the copper bearing material is a copper chloride.

18. The process of claim 17 wherein the copper chloride is introduced into the reactor at a rate which allows it to be flash vaporized and reacted substantially instantaneously with the hydrogen gas to form elemental copper.

19. A process for recovering elemental copper from solid copper bearing materials selected from the group of copper chlorides consisting of copper chlorides and copper oxychlorides, which comprises:

finely dividing the copper bearing materials to a particle size of less than about 500 microns;

maintaining the temperature of a reaction chamber above the temperature of the melting point of copper;

injecting hydrogen gas into the reactor at a sufficient velocity and angle to create turbulent conditions within the reactor;

injecting the copper bearing material into the reactor at a rate which allows it to be reacted substantially instantaneously with the hydrogen gas; and recovering molten copper from the bottom of the reactor and copper particles from the gas stream.

20. The process of claim 19 wherein the reactor is maintained at a temperature of from about 1100° C. to about 1200° C.

21. The process of claim 19 wherein the copper bearing material is a copper chloride.

22. The process of claim 21 wherein the copper chloride is selected from the group consisting of cupric chloride and cuprous chloride.

23. The process of claim 22 wherein the copper chloride is cuprous chloride.

24. The process of claim 23 wherein the cuprous chloride is injected into the reactor under conditions which allow it to be flash vaporized and reacted essentially instantaneously with the hydrogen gas.

25. The process of claim 19 wherein the reactor is a cyclone reactor.

26. The process of claim 19 wherein the hydrogen and copper bearing material are injected together into the cyclone reactor.

27. The process of claim 24 wherein the hydrogen gas is injected at a velocity of from about 9 to about 27 meters per second.

28. A process for reducing cuprous chloride with hydrogen to elemental copper which comprises:

sizing the cuprous chloride to less than about 100 microns;

injecting the solid cuprous chloride into a cyclone reactor whose interior walls are maintained at a temperature of from about 1100° C. to about 1200° C., thereby immediately flash vaporizing the cuprous chloride;

injecting hydrogen gas tangentially into the reactor at a velocity of from about 9 to about 27 meters per second in order to create and maintain the cyclone and permit a substantially instantaneous reaction with the cuprous chloride to form elemental copper;

coalescing at least a portion of the elemental copper within the cyclone; and recovering molten copper from the bottom of the reactor and copper particles from the gas stream.

29. The process of claim 28 wherein the hydrogen is injected at a velocity of from about 17 to about 22 meters per second.

30. The process of claim 28 wherein the substantially instantaneous reaction between the cuprous chloride and hydrogen occurs within one second.

* * * * *